US008191712B2

(12) United States Patent
Koett

(10) Patent No.: US 8,191,712 B2
(45) Date of Patent: Jun. 5, 2012

(54) SURFBOARD PROTECTOR

(75) Inventor: Jared Koett, San Diego, CA (US)

(73) Assignee: Surf Travel Solutions, Inc., San Diego, CA (US)

( * ) Notice: Subject to any disclaimer, the term of this patent is extended or adjusted under 35 U.S.C. 154(b) by 0 days.

(21) Appl. No.: 12/870,679

(22) Filed: Aug. 27, 2010

(65) Prior Publication Data

US 2011/0048984 A1 Mar. 3, 2011

Related U.S. Application Data

(60) Provisional application No. 61/275,378, filed on Aug. 28, 2009, provisional application No. 61/278,937, filed on Oct. 14, 2009, provisional application No. 61/334,038, filed on May 12, 2010.

(51) Int. Cl.
*B65D 81/02* (2006.01)

(52) U.S. Cl. ..... 206/586; 206/315.1

(58) Field of Classification Search ..... 206/315.1, 206/586, 523, 453, 521, 335; 224/314, 917; 150/154; 441/74; 114/361, 219, 352; D21/776
See application file for complete search history.

(56) References Cited

U.S. PATENT DOCUMENTS

| | | | | |
|---|---|---|---|---|
| 1,045,594 | A | | 11/1912 | Nyberg |
| 3,339,607 | A | | 9/1967 | Howard |
| 3,374,495 | A | | 3/1968 | Joyce |
| 4,483,380 | A | | 11/1984 | Beran |
| 4,586,451 | A | | 5/1986 | Mori |
| 4,719,952 | A | | 1/1988 | Geronimo |
| 4,778,710 | A | * | 10/1988 | Deutsch ..... 428/192 |
| 4,792,316 | A | * | 12/1988 | Skedeleski et al. ..... 441/74 |
| 4,823,998 | A | * | 4/1989 | Johnson ..... 224/150 |
| 5,014,955 | A | * | 5/1991 | Thompson ..... 248/309.1 |
| 5,022,678 | A | | 6/1991 | Mayfield |
| 5,033,497 | A | * | 7/1991 | Hernandez ..... 135/95 |
| 5,094,344 | A | * | 3/1992 | Savage ..... 206/315.1 |

(Continued)

FOREIGN PATENT DOCUMENTS

JP 3050376 U 4/1998

OTHER PUBLICATIONS

"Ding Bag—To Surf and Protect", internet printout Aug. 24, 2010, http://www.dingbag.com/merchandise.htm.

(Continued)

*Primary Examiner* — Steven A. Reynolds
(74) *Attorney, Agent, or Firm* — Mark D. Wieczorek; Mayer & Williams PC

(57) ABSTRACT

An adjustable surfboard transporter that protects the most fragile parts of a surfboard whether in transit or for storage. The surfboard protector or transporter can be adjusted in size to accommodate several different surfboard lengths. The transporter may focus on the most vulnerable parts of the surfboard protecting the nose, tail, and rails. In particular, an adjustable protective cover for the fragile outer perimeter of a surfboard is described. The light and durable form of protection cushions the surfboard to prevent damage from impacts. The system may be easy to use, quick to assemble, and may be broken down to an easily-transportable or storable size.

15 Claims, 10 Drawing Sheets

U.S. PATENT DOCUMENTS

| | | | | |
|---|---|---|---|---|
| 5,147,235 | A | 9/1992 | Bamburak et al. | |
| 5,163,550 | A | 11/1992 | Hawk | |
| 5,193,677 | A | 3/1993 | Moreno | |
| 5,664,808 | A * | 9/1997 | Whidden et al. | 280/815 |
| 5,967,314 | A * | 10/1999 | McGovern | 206/315.1 |
| 6,003,745 | A | 12/1999 | Mechanic | |
| 6,799,707 | B2 * | 10/2004 | Gibson | 224/609 |
| 7,017,747 | B2 | 3/2006 | Kiger et al. | |
| 2004/0108233 | A1 * | 6/2004 | Coulson | 206/315.1 |
| 2004/0178243 | A1 | 9/2004 | Clark et al. | |
| 2006/0016842 | A1 * | 1/2006 | Lu | 224/600 |
| 2006/0289584 | A1 * | 12/2006 | Lu | 224/605 |
| 2007/0125671 | A1 * | 6/2007 | Stephens | 206/315.1 |

OTHER PUBLICATIONS

"Dingall—Ding All Air Cell Surfboard Guard Triple Ding Repair", internet printout Aug. 24, 2010, http://www.surfboards.com/product_info.php?products_id=369.

"Fcs Balin dakine surfboard bags", internet printout Aug. 24, 2010, http://www.lajollasurfshop.com/boardbags.htm.

"foam-blocks-1—Stay Covered", internet printout Aug. 24, 2010, http://www.staycovered.com/product/foam-blocks-1.

"StandupZone Reviews—Rail Saver", internet printout Aug. 24, 2010, http://www.standupzone.com/reviewpost/showproduct.php?product=102.

* cited by examiner

SURFBOARD PROTECTOR

CROSS-REFERENCE TO RELATED APPLICATIONS

This application claims benefit of priority of the following U.S. Provisional Patent Applications: Ser. No. 61/275,378, filed Aug. 28, 2009, entitled "Adjustable Surfboard Transporter"; Ser. No. 61/278,937, filed Oct. 14, 2009, entitled "Adjustable Surfboard Transporter"; and Ser. No. 61/334,038, filed May 12, 2010, entitled "Attachment Device for Segmented Surfboard". These applications are each incorporated by reference in their entirety.

BACKGROUND

The fiberglass construction of modern surfboards is necessary for weight and maneuverability. However, given the harsh surf environment, modern surfboards are prone to accumulating dings, which are dents or other damage due to collision with rocks, etc. Dings also occur as the result of travel, especially as it is becoming more common for surfers to bring their surfboards to experience surfing at locations around the world. In fact, surf travel is a sizable niche in the travel industry.

Several products exist to address the problem of surfboard damage during travel. These products each have various drawbacks, which in many cases can be categorized as follows. First, the product's performance does not warrant the price. Second, many products have difficulty achieving a custom fit, as necessary for varying sizes of surfboards. For example, some products include bags in which a surfboard may be inserted, where the bag is equipped with foam for ding protection. Unfortunately, these products are not adjustable and further lack protection against sudden sharp impacts. Other products work to focus protection on the nose or tail of the surfboard. However, these lack protection of surfboard rails. Still other products protect the nose, tail, and rails, but not to a sufficient degree, and not in a way that is adjustable to fit varying sizes of surfboards. Additional attempts at protecting surfboards include large hard suitcases in which a surfboard may be stored during travel. However, such solutions are generally very heavy and expensive.

In more detail, surfboard protection devices have been disclosed in, e.g., the Geronimo (U.S. Pat. No. 4,719,952), Mori (U.S. Pat. No. 4,586,451 and Joyce (U.S. Pat. No. 3,374,495) patents. All three designs describe a molded, wrap-around protector. None of these designs, however, provide both comprehensive protection of key areas such as the nose, tail, and rails, nor are they especially versatile to use. Joyce (U.S. Pat. No. 3,374,495) discloses a nose bumper that affixes to the tip of a surfboard by means of an adhesive. Triangular-shaped cut outs are made along its upper and lower walls to increase its flexibility. Although form-fitting, the design lacks protection in the tail and rails and is a permanent fixture. Mori (U.S. Pat. No. 4,586,451) utilizes a system of partial covers to protect the surfboard. These are forced on non-adhesively and fastened by belts. The coverage provided is limited, and it may be unwieldy to transport the numerous parts and awkward belts. Geronimo (U.S. Pat. No. 4,719,952) employs a design that provides protection of the areas most susceptible to damage. His design, however, is non-adjustable and would fit the form of just a single surfboard. A user would be required to purchase a custom cover for each surfboard owned.

SUMMARY

An adjustable and protective cover for the fragile outer perimeter of a surfboard is described. Intended in one embodiment for preparing a surfboard before travel, the light and durable form of protection cushions the surfboard to prevent damage from impact sustained en route. One embodiment employs a nose protector, a tail protector, and railguards that protect the rails of the surfboard. The railguards may be attached to each other and to the nose or tail protector in an adjustable fashion, such as by an adaptor that can attach to the railguards in a number of positions.

In one implementation, the invention is directed towards an adjustable assembly for protecting a surfboard during transit and/or in storage. The invention includes a nose protector, the nose protector structured and configured to receive at least a portion of a nose of a surfboard. The invention also includes a tail protector, the tail protector structured and configured to receive at least a portion of a tail of a surfboard. First and second left railguards are included that are structured and configured to receive at least a portion of a left rail of a surfboard, where the first left railguard is configured to be attached to a left side of the nose protector and where the second left railguard is configured to be attached to a left side of the tail protector. First and second right railguards are included that are structured and configured to receive at least a portion of a right rail of a surfboard, where the first right railguard is configured to be attached to a right side of the nose protector and where the second right railguard is configured to be attached to a right side of the tail protector. A left adaptor and a right adaptor are included, the left and right adaptor structured to connect the first and second left railguards and the first and second right railguards, respectively, such that the first and second left railguards and the first and second right railguards may be separated by one of a variety of distances while being held securely by the left and right adaptor, respectively.

Implementations of the invention may include one or more of the following. At least one of the nose protector, the tail protector, and one of the railguards may be constructed of a bilayer, a first layer constructed of a foam, and a second layer constructed of a hard shell material. The first layer may be made of polyethylene foam or a biofoam, and the second layer may be made of a material selected from the group consisting of Surlyn®, a biodegradable material such as cardboard, ABS plastic, and combinations thereof. The assembly may further include a third layer coating the second layer on the face of the second layer opposite the first layer, and the third layer may be made of rubber. A portion of the railguards may define a slot and a portion of the nose or tail protector may have formed thereon a protrusion, such that engagement of the protrusion and the slot causes the railguard to be attached to the nose protector or tail protector a portion of the railguards defines a groove and a portion of the nose protector has formed thereon a tongue, such that engagement of the tongue and the groove causes the railguard to be attached to the nose protector. A portion of the railguards may define a groove and a portion of the tail protector may have formed thereon a tongue, such that engagement of the tongue and the groove causes the railguard to be attached to the tail protector. At least a portion of the railguards may have corrugations formed therein. The adaptor may snap-fit to a pair of railguards. The adaptor may have formed thereon, on one or both edge(s), a nub for engagement with an edge of a railguard. At least a portion of the railguards may have corrugations formed therein, and a height of the corrugations may be substantially equal to a height of the protrusion.

In another aspect, the invention may be directed to an adjustable assembly for protecting a surfboard during storage, including a nose protector configured to receive a nose of a surfboard, a tail protector configured to receive a tail of a surfboard, and means to adjust a distance between the nose protector and the tail protector, the adjustment means including one or more railguards configured to receive at least a portion of a rail of a surfboard.

Implementations of the invention may include one or more of the following. The two railguards may span a length of each surfboard rail. The nose protector and the tail protector may be each composed of a bilayer structure, the bilayer structure including a hard exterior and a soft form interior. Each of the nose protector, the tail protector, and the railguards may be structured and configured to attach to a surfboard by a friction fit. An adaptor may be included that is configured to attach two railguards together, the adaptor attaching to each railguard by a friction fit. At least one railguard may be attached to the nose protector using an attachment mechanism, and moreover at least one railguard may be attached to the tail protector using an attachment mechanism.

Another embodied system or assembly employs three basic elements. One piece fits closely to the outer perimeter of the upper half of the surfboard. A second piece does the same for the lower half of the surfboard. A third piece fits over a series of channels that line the sides of each arm creating a union. When necessary, the halves can be spaced apart in order to accommodate a different length of surfboard. The third piece may bridge the divide between the two halves, align with the channels, and help secure the cover to the surfboard. This feature makes the design adjustable and thus effective for multiple surfboards.

Additional advantages of the invention may include one or more of the following. The system may be adjusted to fit multiple sizes and can be used interchangeably between surfboards of a similar shape. Further, certain elements of the assembly can be made universal to fit surfboards of a different shape, e.g., railguards may protect the rails of a modern thruster and a modern fish. The system is reusable. The system may be easy-to-use, quick to assemble, versatile, adjustable, effective against damage, durable, practical to store, and may provide a comprehensive solution to the problem of surfboard damage during travel. Other advantages will be apparent from the description that follows, including the figures and claims.

DETAILED DESCRIPTION

Figure 1:
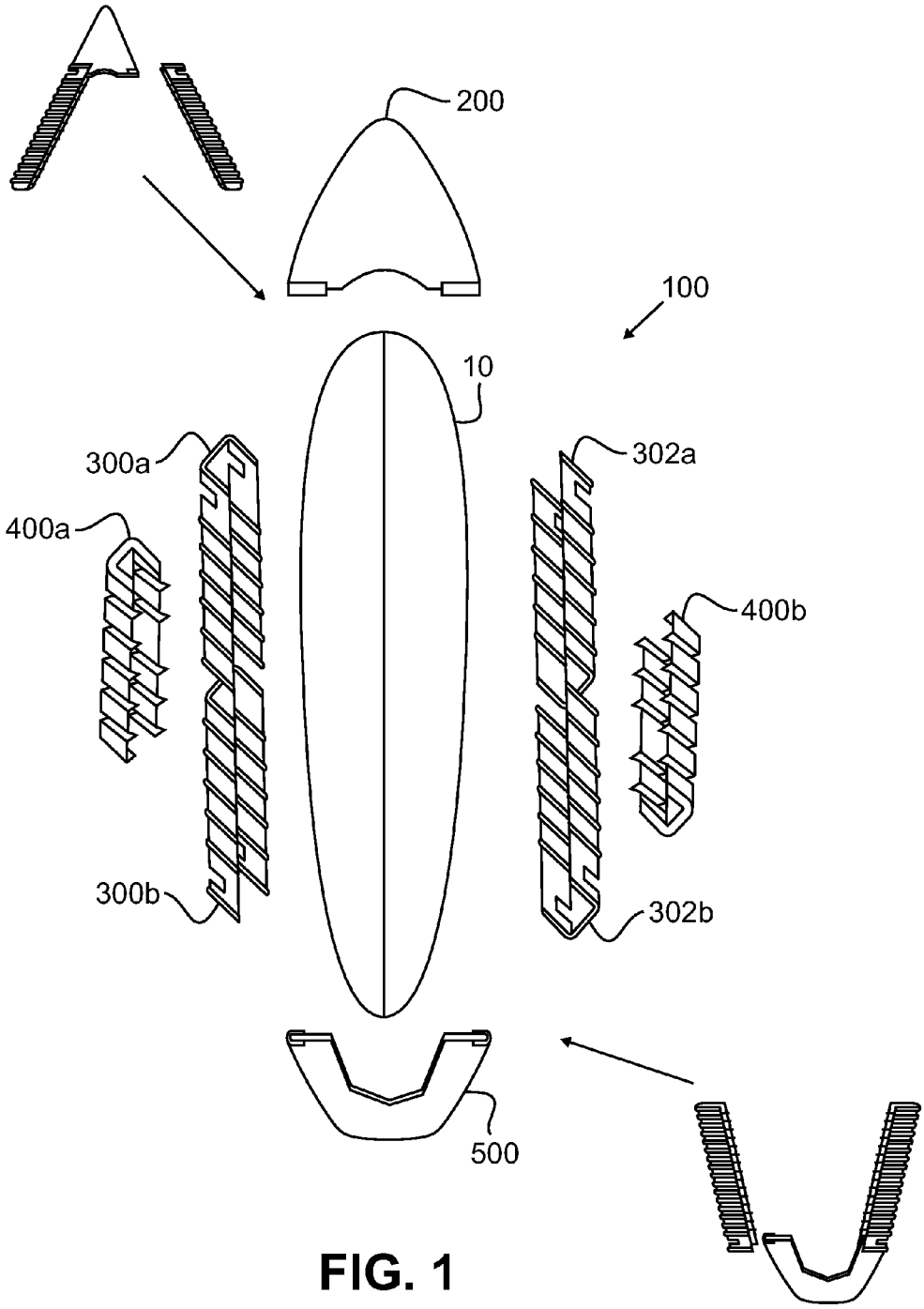
FIG. 1 is a perspective exploded view of the components of a surfboard protector according to an embodiment of the invention, surrounding a surfboard.

Referring to FIG. 1, a perspective view is illustrated of a system or assembly 100 of an embodiment of the invention surrounding a surfboard 10. The system or assembly 100 includes a nose protector 200, a tail protector 500, a left railguard assembly, which in this embodiment has been split into two left railguards 300*a* and 300*b*, and a right railguard assembly, which in this embodiment has been split into two right railguards 302*a* and 302*b*. An attachment mechanism such as an adaptor 400*a* serves to join the two left railguard portions in a secure fashion and in the same way an attachment mechanism such as an adaptor 400*b* serves to join the two right railguard portions. Additional details about the nose and tail protectors and the railguards and attachment mechanisms are described below.

Referring to FIG. 2(A)-(E), additional details about the nose protector 200 are seen. In particular, the nose protector 200 includes nubs, protrusions, or ramps 202 and 204, hereinafter termed "protrusions". These protrusions 202 and 204 engage slots 208 on the railguards 300*a* and 302*a* to hold the railguards securely to the nose protector. As is described in greater detail below, the railguards 300*a* and 302*a* may be equipped with ribs or corrugations, and the railguards may slide onto the protrusion of the nose protector in a fashion substantially parallel to the corrugations.

The protrusions may be slightly sloped and have substantially the same height as a rib or corrugated portion of the railguard. The female part may be a slit near the terminus of the railguard. In constructing the protector around the surfboard, first the nose protector and tail protector would be mounted on to their respective surfboard sections. The raised protrusions would be exposed and ready for insertion. Next, the railguard would be fitted over the rail. The terminus end with the slit or hole defined may be slid over the raised protrusion until the protrusion is fitted into this slit or hole. Next, the adaptor slides over the corrugations of each railguard, connecting both and bridging the gap of exposed surfboard. This procedure is then repeated for the railguards on the other side of the surfboard.

Figure 2A:
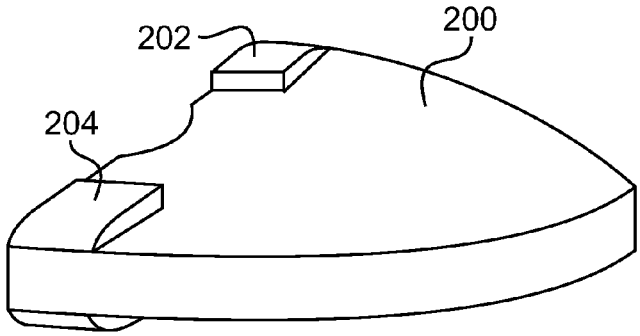
FIG. 2 illustrates various views of a nose protector according to an embodiment of the invention, as well as views of the nose protector attached to railguards.
Figure 2B:
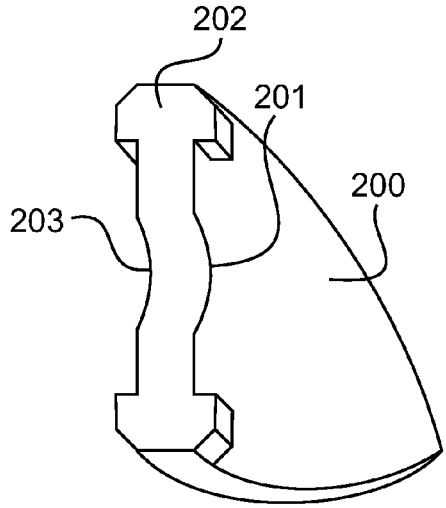
Figure 2C:
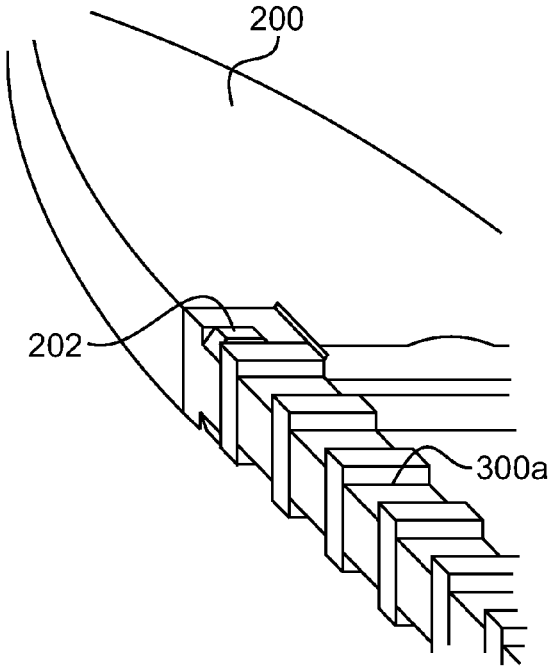
Figure 2D:
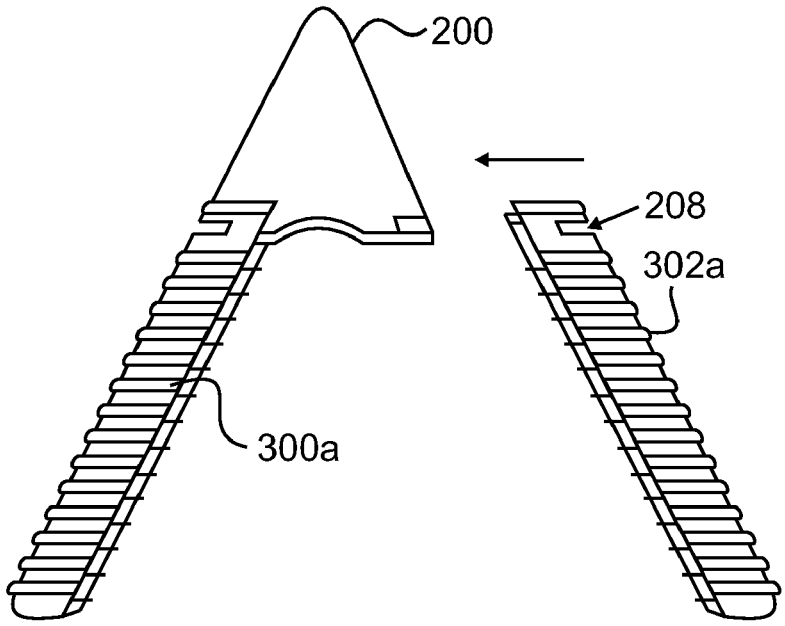

As may be seen in particular in FIG. 2(B), the nose protector 200 may have formed thereon an invagination 201 and a groove 203. These elements may allow the systems 100 to be conveniently stacked. Invagination 201 and groove 203 are also reference points for the insertion of the tip of the surfboard and a means of releasing the protrusions from their slots by squeezing the edges of these grooves.

Figure 2E:
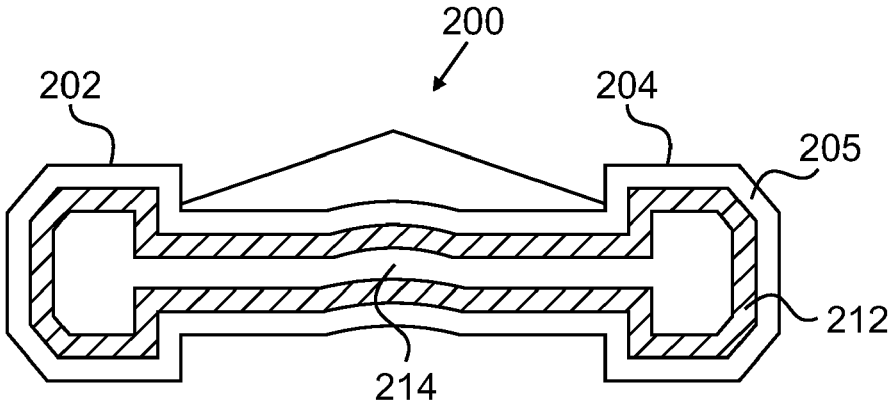

Referring to FIG. 2(E), the system 100 may employ a bilayer construction, and this is also true of the nose protecter 200 and tail protector 500. That is, the nose protecter 200 may employ a hard shell exterior 205 and the softer foam interior 212. In the area of the nose protector 200, a hole 214 may be defined into which a surfboard nose may be inserted.

Figure 3A:
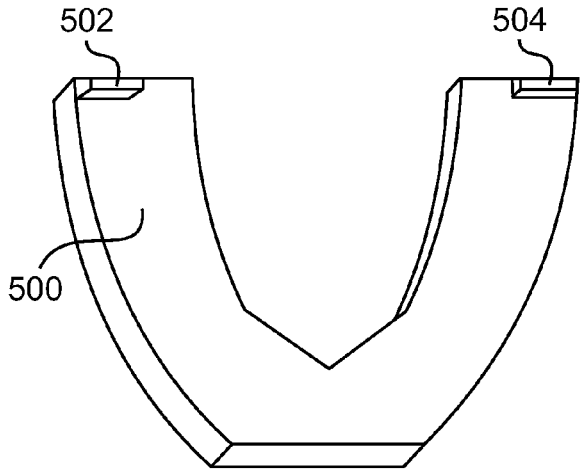
FIG. 3 illustrates various views of a tail protector according to an embodiment of the invention, as well as views of the tail protector attached to railguards.
Figure 3B:
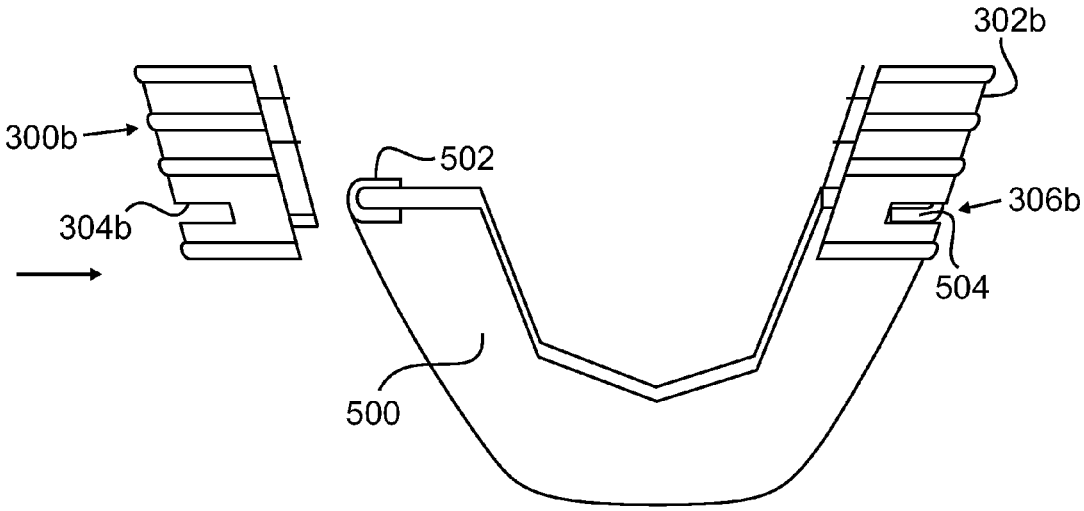

Referring to FIGS. 3(A) and 3(B), the tail protector 500 is in some ways similar to the nose protector 200. As with the nose protector 200, the tail protector 500 may be equipped with protrusions 502 and 504 which matingly engage corresponding holes 304*b* and 306*b* defined in railguards 300*b* and 302*b*, respectively. The tail protector may have the same sort of bilayer construction discussed above in connection with the nose protector.

Figure 4A:
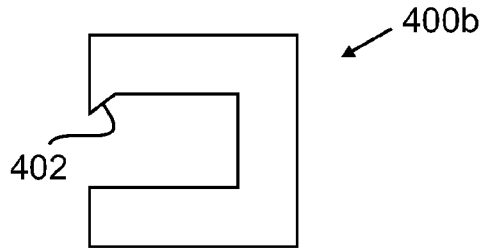
FIG. 4 illustrates various views of a railguard and adaptor structure according to an embodiment of the invention.
Figure 4B:
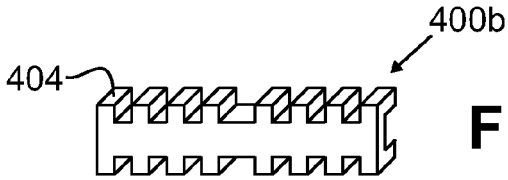
Figure 4C:
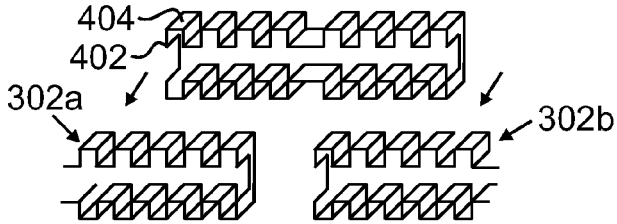
Figure 4D:
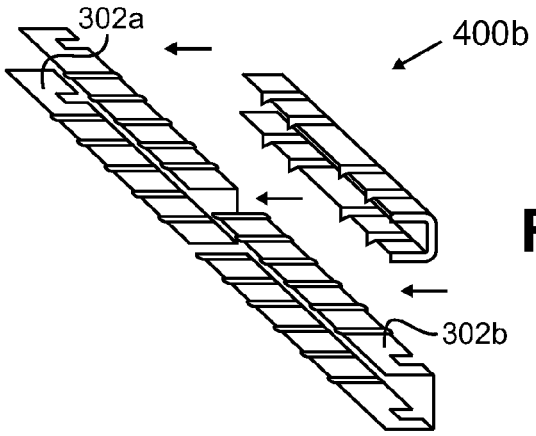
Figure 4E:
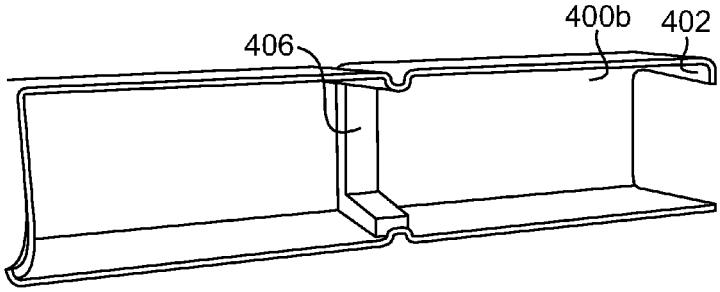

Referring to FIG. 4(A)-(G), embodiments of the railguards and adaptors are illustrated. Besides various views, it is noted that FIG. 4(B) depicts an exterior view of an adaptor and FIG. 4(C) depicts an interior view. For example, a railguard 302*a* is illustrated adjacent a railguard 302*b*. An adaptor 400*b* is shown spanning the same. The adaptor 400*b* includes a number of corrugations 404, and at the base of one or more corrugations is disposed a nub 402. The adaptor 400*b* slides over and fits onto the corrugations in the railguards, and the nub 402 helps hold the adaptor onto the railguards. The corrugations generally allow secure positioning of the railguards at a given distance apart, and thus allow the system or assembly to be rendered adjustable—accommodating various sizes of surfboards. While in FIG. 4(A)-(G) corrugations are illustrated on both the adaptor and on the railguards, it will be understood that in some embodiments corrugations need only be on the adaptor or on the railguard. So long as the adaptor can be held securely onto the railguard in such a way as to prevent significant longitudinal movement (i.e., movement along the direction of the axis of the surfboard), any adaptor/railguard configuration will work. For example, in FIG. 4(E), no corrugations are illustrated on the adaptor. However, a foam section 406 is provided in the center, and the same may be contacted by each railguard in the case that the shortest system or assembly is constructed. The foam section 406 protects the rail of a surfboard in the general case where the railguards are separated by a gap and where the surfboard and protector receive a blow in the midsection. That is, where the adaptor would otherwise strike the rail without any foam protection.

Figure 4F:
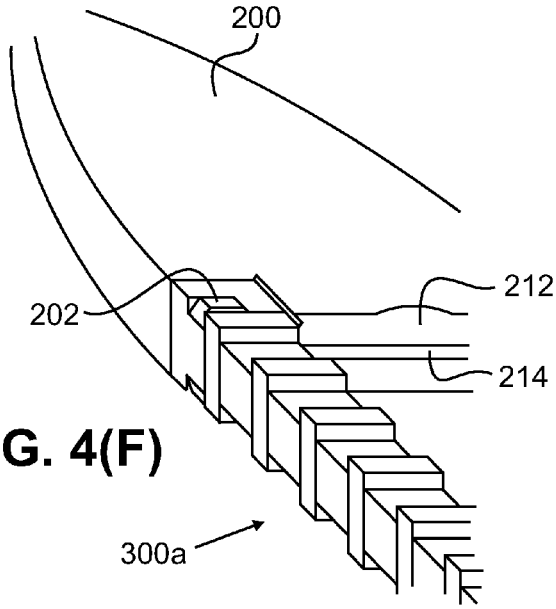
Figure 4G:
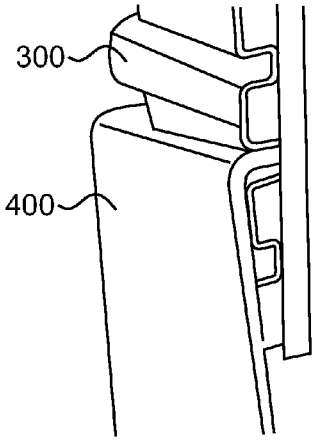

FIG. 4(G) illustrates how an adaptor may fit over a snap onto a railguard, and in this case is disposed between two corrugations. In this figure, the nub is not illustrated for clarity. In addition, it will be understood that the adaptor nubs may also snap onto the corrugations themselves. FIG. 4(F) further illustrates the connection of a railguard to the nose protector.

Figure 5:
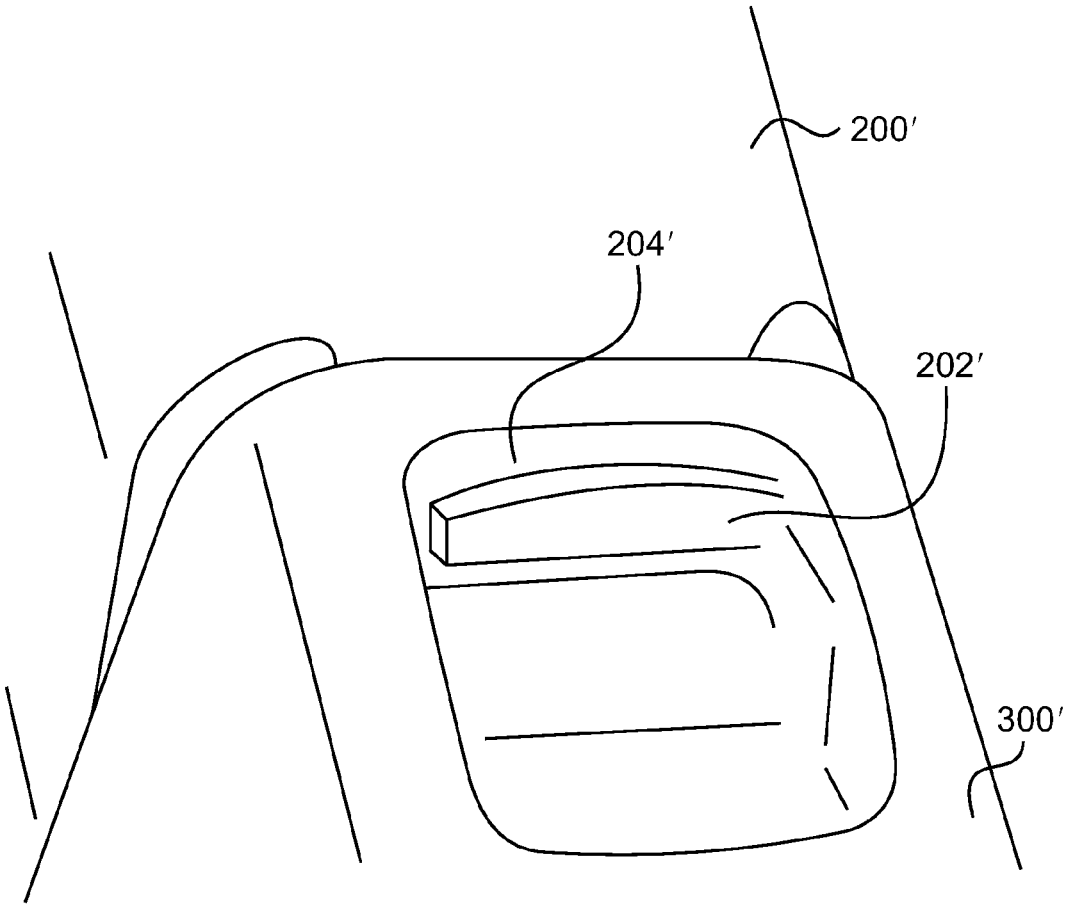
FIG. 5 illustrates an alternative device that may be employed to connect a railguard to the nose or tail protectors.

FIG. 5 illustrates an alternative attachment mechanism between a nose protector 200' and a railguard 300'. In particular, a tongue 202' formed on the nose protector 200' may be rotatably inserted into a corresponding hole formed in or defined by the railguard 300'. Besides these techniques, one of ordinary skill in the art will recognize other attachment mechanisms given these teachings. In any of these cases, a left railguard will attach at one point to the left side of a nose protector, and a right railguard will attach at one point to the right side of a nose protector. Analogous attachments will be seen for the left and right railguards and the left and right portions of the tail protector.

In an alternative embodiment, disclosed in an application (Ser. No. 61/278,937) incorporated by reference above and further described with reference to FIG. 6(A)-(F) as noted below, the system may be made from polyethylene foam reinforced by Surlyn®, a plastic resin. The system overlaps the outer perimeter of the surfboard on its edges. Extended coverage is placed on the nose and tail. Polyethylene foam creates a light, flexible, and shock absorbing core that is reinforced by a strong and durable Surlyn® shell. Together they provide considerable protection against impact. The system may be installed first on the nose protector and tail protector of the surfboard. At this point, the railguards have not been secured to the rails of the surfboard. Once the nose protector and tail protector fit snuggly onto their respective positions, the railguards are then slid onto the rails of the surfboard. Next, the adaptor attaches to the railguard and secures the system to the surfboard. The nose protector may attach to the railguard by the Surlyn® along the edge, i.e., the nose protector has a horizontal slit where the nose of the surfboard inserts. (Other methods may be employed as well.) The joints between the tail protector and railguards act as hinges that swing open allowing the system to easily accommodate the tail and rails. These joints exist in the upper half as well. In cuts are made along the arms of both the upper and lower halves of the design to decrease rigidity. A series of channels may be employed along the edge where the two halves of the system meet. These channels serve as anchorage points for the adaptor. Cast from a plastic resin, the adaptor is shaped in a complimentary form to the pattern of the channels and arms. This piece connects the two halves, further secures the system in position, and protects the rails of the surfboard from damage.

Figure 6A:
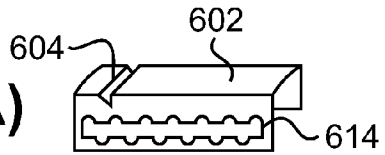
FIG. 6 illustrates an alternative adaptor configuration.
Figure 6B:
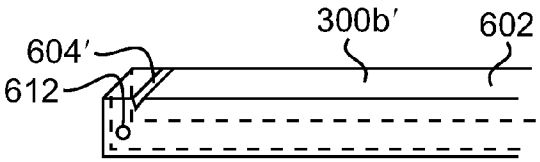
Figure 6C:
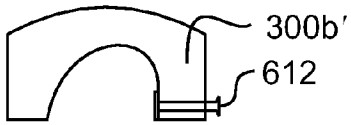
Figure 6D:
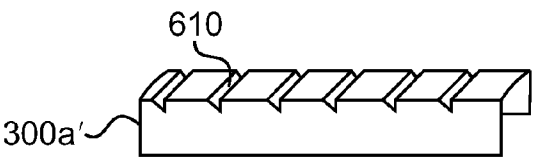
Figure 6D:
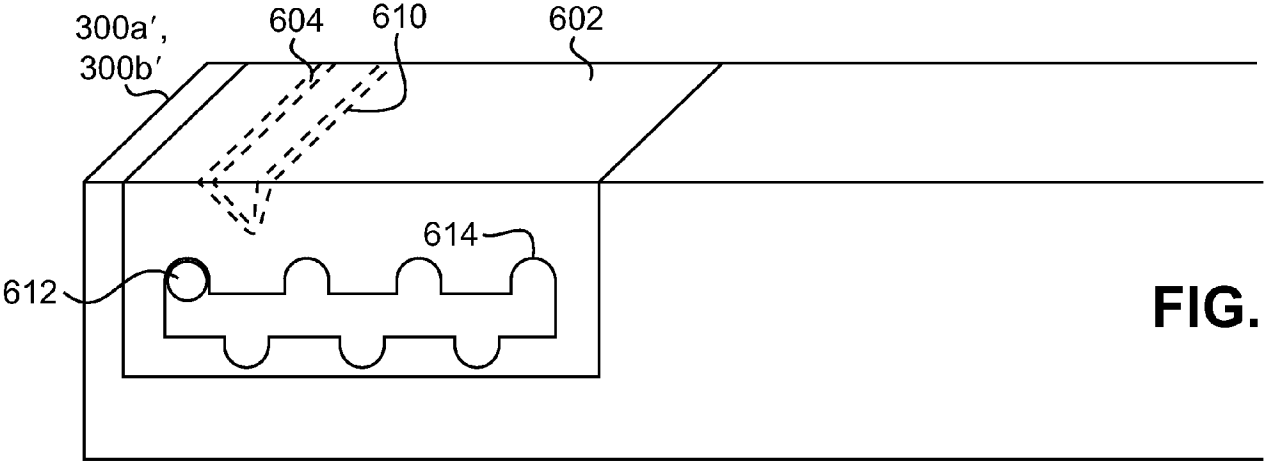
Figure 6E:
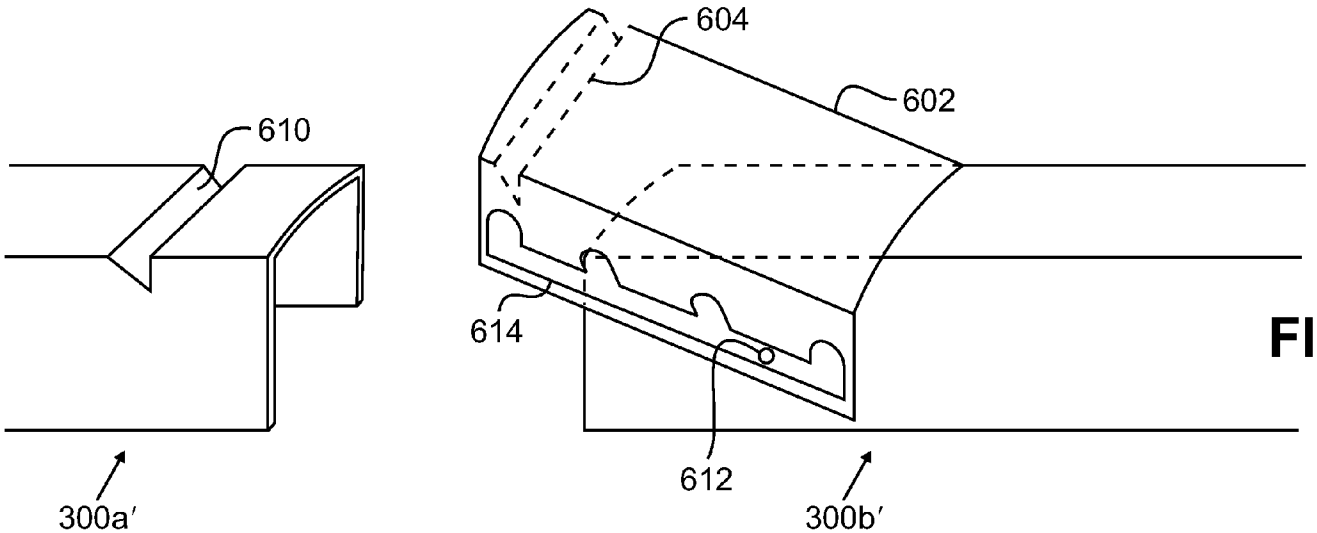
Figure 6F:
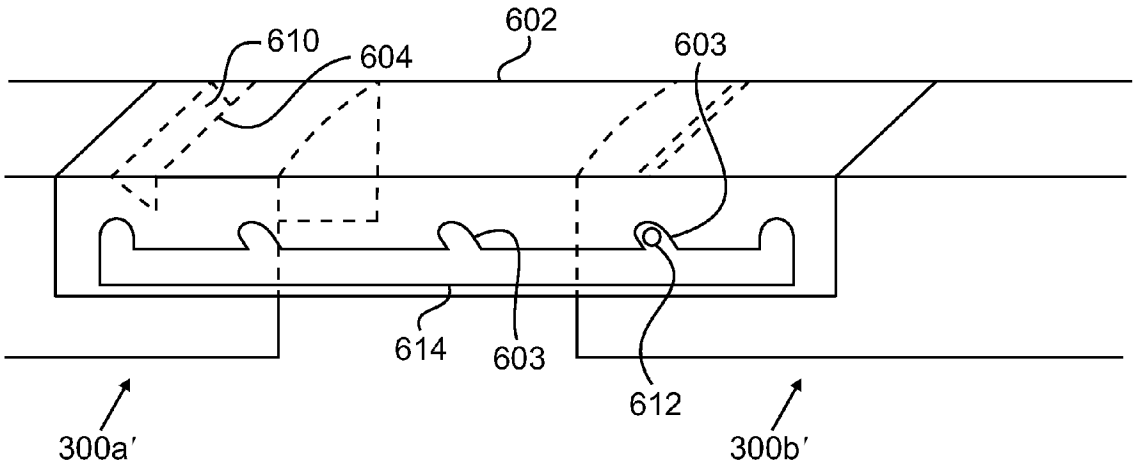

FIGS. 6(A)-(F) illustrate this alternative adaptor assembly in which an adaptor attaches to a railguard permanently and is capable of moving both forward and back. This system may be difficult to form via the vacuum forming techniques that are one way of creating the prior embodiments, but the system of FIG. 6 may still be formed by other methods. The adaptor may lock on to an opposing railguard and secure both railguards into place by various different methods including, but not limited to, clamps, cinches, ratchets, tongue and groove systems, and/or elastic bands. One method may function in the following way. An adaptor 602 defines a pattern 614 in its side. This pattern serves as a track for an anchor 612. The anchor 612 is embedded into the side of a railguard **300*b*'. FIG. 6(B) illustrates how the adaptor 602 may be situated in a rest position on the railguard 300*b*' when not in use. When the length needs to be adjusted, the adaptor 602 slides along the railguard until the desired position is obtained, then one or more teeth 604 hook into one or more channels 610 of the opposing railguard 300*a*'. Taking the "anchored end" of the adaptor 602, the grooves 603 are pulled over the anchor 612** creating a locked-in position.

In other words, the teeth 604 fit into grooves 610. The anchor 612 can be moved within the channel 614 when the teeth 604 are not positioned inside the groove 610. When the teeth 604 fit inside the groove 610, the anchor engages one of several slots 603 along channel 614 causing the adaptor 602 to lock on the railguards, disallowing movement. In order to adjust the adaptor 602 according to board length, the teeth 604 lift up out of the groove 610, disengaging the anchor from its slot 603, allowing it to move freely along the track of channel 614. By connecting the adaptor to the arms, the likelihood of losing a part is reduced.

Figure 7:
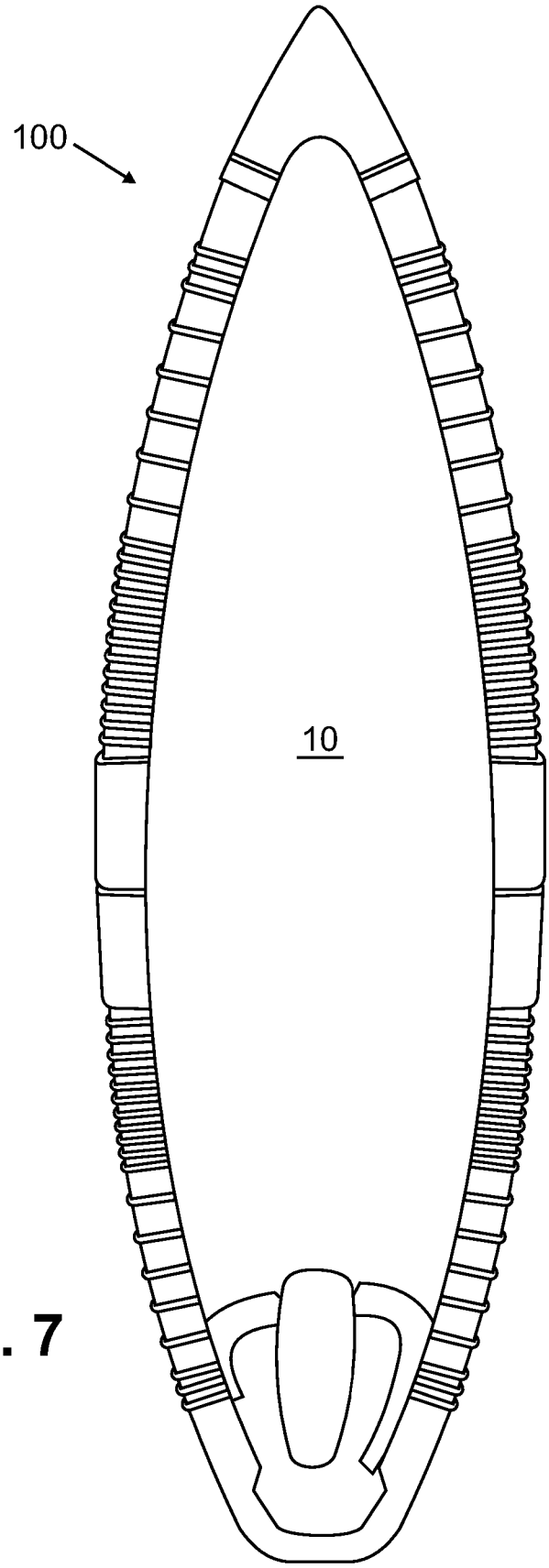
FIG. 7 illustrates a perspective view of the embodiment of the surfboard protector in use.

FIG. 7 illustrates a system or assembly 100 in use protecting a surfboard 10.

Certain details of the embodiments are discussed below.

The corrugations may be, e.g., spaced apart by a range of distances from 0.25 inches to more than 1 inch, e.g., 0.75 inches or 1 inch. The corrugations may have a depth that varies between about 0.12 inches and 0.5 inches, e.g., ¼ inch. An optional flanged section on the railguard, adjacent the portion forming the slot, may provide a face at an angle to ease attachment/detachment of the railguard to the nose protector or tail protector. In other words, the flange may allow the railguard to be more easily and conveniently mounted to/dismounted from the nose or tail protectors by lifting the same to slide over the protusion smoothly. The face of the flange may at an angle of, e.g., 30°. The thickness of the hard shell exterior, e.g., the Surlyn®, may be, e.g., ⅛" to ¼", e.g., 3/16". The thickness of the softer foam material may be, e.g., ¼" to ½". These thicknesses may vary, however, not only from surfboard protector to surfboard protector, but also within a given surfboard protector.

The system or assembly may be made to fit surfboards of varying designs including hybrids, fish, longboards, SUPs, and so forth. In addition, the system or assembly may be employed to protect other fragile products, especially those whose length may vary but whose overall shape remains constant, e.g., snowboards, artwork, laptops, airplane wings, foils, or the like. The system or assembly may be made stackable by pressing a groove into the top of each assembly and an invagination into the bottom of each assembly. It will be understood that variations of this design may also be employed to provide a stackable feature. Such channel and groove features allow stackability regardless of the dimension of the surfboard—in this aspect, the surfboards and protectors may not be centered one atop the other, but so long as an invagination is engaging a groove somewhere on the railguards or nose or tail protectors, the surfboards may be securely stacked.

While the above description has described the invention in terms of specific exemplary embodiments, it will be understood that the same are purely for illustration, and that many variations of the above will be seen by one of ordinary skill in the art given this teaching. For example, instead of a segmented design where nose and tail protectors mate with railguards, a large enough tool could allow just two segments to be manufactured, e.g., a nose protector and tail protector with integral railguards that are coupled together with an adaptor. In a related embodiment, the railguards may be non-integral but hingedly attached to the nose or tail protectors.

In another variation, the system may be supplemented by being removably encased in a surfboard bag, the bag serving to further protect the surfboard as well as the nose and tail protectors and railguards. In a related embodiment, the railguards and nose and tail protectors may be equipped with attachment mechanisms, e.g., buttons or snaps, by which flat bags may be spanned and attached. These flat bags may be opened by zippers or other known techniques. By inserting clothing, blankets, towels, wetsuits, or the like into the flat bags, additional storage may be gained for travel, and additional protection is afforded to the top and bottom of the surfboard. To create the flat bags, two layers of threaded mesh may be sewn together around their perimeter. In another embodiment, instead of the flat bags, flexible foam sheets may be attached in the same way. The flexible foam sheets provide protection against damage, and may be employed during a trip as a yoga mat, pillow, or as an extra cushion. Additional pockets may be sewn into the mesh or foam to provide storage for small items.

In another variation, large bands, e.g., similar to large rubber bands or bungee cords, may further be employed to retain the protective pieces by circling the same in a rail-to-rail fashion around the board and protector. The disclosed adaptors may be replaced with various other designs. For example, to connect together two railguards in an adjustable fashion, elastic bands may be employed. Alternatively, one railguard may have mounted thereon a mechanism that can matingly engage with another railguard in a variety of positions. For example, one mechanism may be an invagination, formed on a piece hingedly mounted to one railguard, that is rotated into one of a set of grooves on another, the insertion allowing a friction-fit, the groove chosen to allow a suitable length of the combined railguards to be achieved. Other mechanisms may be Velcro® straps, clamps, bindings such as those found on ski boots, or the like. Therefore, the scope of the invention is to be determined solely by the scope of the claims appended hereto, and equivalents thereof.

The invention claimed is:

1. An adjustable assembly for protecting the full perimeter of a surfboard during transit and/or in storage, comprising:

a nose protector, the nose protector structured and configured to receive at least a portion of a nose of a surfboard;

a tail protector, the tail protector structured and configured to receive at least a portion of a tail of a surfboard;

first and second left railguards, the first and second left railguards structured and configured to receive at least a portion of a left rail of a surfboard, wherein the first left railguard is configured to be attached to a left side of the nose protector and wherein the second left railguard is configured to be attached to a left side of the tail protector;

first and second right railguards, the first and second right railguards structured and configured to receive at least a portion of a right rail of a surfboard, wherein the first right railguard is configured to be attached to a right side of the nose protector and wherein the second right railguard is configured to be attached to a right side of the tail protector;

a left adaptor and a right adaptor, the left and right adaptor structured to connect the first and second left railguards and the first and second right railguards, respectively, such that the first and second left railguards and the first and second right railguards may be separated by one of a variety of distances while being held securely by the left and right adaptor, respectively, such that the full perimeter of a surfboard is collectively protected by the nose protector, tail protector, railguards, and adaptors.

2. The assembly of claim 1, wherein the nose protector, the tail protector, and the railguards are constructed of a bilayer, a first layer constructed of a foam, and a second layer constructed of a hard shell material.

3. The assembly of claim 2, wherein the first layer is made of polyethylene foam or a biofoam.

4. The assembly of claim 2, wherein the second layer is made of a material selected from the group consisting of: Surlyn®, a biodegradable material, and ABS plastic.

5. The assembly of claim 2, further comprising a third layer coating the second layer on the face of the second layer opposite the first layer.

6. The assembly of claim 5, wherein the third layer is made of rubber.

7. The assembly of claim 1, wherein a portion of the first left and first right railguards defines a slot and a portion of the nose protector has formed thereon a protrusion, such that engagement of the protrusion and the slot causes the railguard to be attached to the nose protector.

8. The assembly of claim 7, wherein at least a portion of the first or second left railguards and first or second right railguards have corrugations formed therein, and wherein a height of the corrugations is substantially equal to a height of the protrusion.

9. The assembly of claim 1, wherein a portion of the second left and second right railguards defines a slot and a portion of the tail protector has formed thereon a protrusion, such that engagement of the protrusion and the slot causes the railguard to be attached to the tail protector.

10. The assembly of claim 1, wherein a portion of the first left and first right railguards defines a groove and a portion of the nose protector has formed thereon a tongue, such that engagement of the tongue and the groove causes the railguard to be attached to the nose protector.

11. The assembly of claim 1, wherein a portion of the second left and second right railguards defines a groove and a portion of the tail protector has formed thereon a tongue, such that engagement of the tongue and the groove causes the railguard to be attached to the tail protector.

12. The assembly of claim 1, wherein at least a portion of the first or second left railguards and first or second right railguards have corrugations formed therein.

13. The assembly of claim 1, wherein the left adaptor snap-fits to the first and second left railguards and the right adaptor snap-fits to the first and second right railguards.

14. The assembly of claim 13, wherein each adaptor has formed on one or both edge(s) a nub for engagement with an edge of a railguard.

15. An adjustable assembly for protecting a full perimeter of a surfboard during storage, comprising:

a nose protector configured to receive a nose of a surfboard;

a tail protector configured to receive a tail of a surfboard; and means to adjust a distance between the nose protector and the tail protector, the adjustment means including one or more railguards configured to receive at least a portion of a rail of a surfboard, such that the nose protector, tail protector, adjustment means, and railguards collectively protect a full perimeter of a surfboard when in use, wherein two railguards are included to span a length of each surfboard rail, further comprising an adaptor configured to attach two railguards together, the adaptor attaching to each railguard by a friction fit.

* * * * *